US005117982A

United States Patent [19]

Shotthafer et al.

[11] Patent Number: 5,117,982

[45] Date of Patent: Jun. 2, 1992

[54] SMALL PART SORTING TRAY

[76] Inventors: Daniel S. Shotthafer; Stephen E. Shotthafer, both of P.O. Box 201, Wrightwood, Calif. 92397

[21] Appl. No.: 594,823

[22] Filed: Oct. 9, 1990

[51] Int. Cl.[5] ..... B07C 7/00

[52] U.S. Cl. ..... 209/614; 141/331; 209/702; 414/675

[58] Field of Search ..... 209/614, 702, 703, 942; 414/675; 53/390; 221/302, 312 R, 312 B, 312 C; 453/3, 5, 8, 9; 141/331, 332, 340; 222/80, 81, 189; 206/0.83, 0.84; 211/10

[56] References Cited

U.S. PATENT DOCUMENTS

| | | | |
|---|---|---|---|
| 1,391,063 | 9/1921 | Kaskell | 206/0.83 |
| 2,507,792 | 5/1950 | King | 414/675 |
| 2,941,342 | 6/1960 | Allen | 414/675 X |
| 3,238,953 | 3/1966 | Barbie | 209/703 X |
| 4,063,645 | 12/1977 | Canterman et al. | 209/702 |
| 4,261,683 | 4/1981 | Zaleon | 209/702 X |
| 4,643,316 | 2/1987 | Hoffmann | 209/614 X |

FOREIGN PATENT DOCUMENTS

| | | | |
|---|---|---|---|
| 973122 | 8/1975 | Canada | 209/702 |

*Primary Examiner*—Donald T. Hajec
*Attorney, Agent, or Firm*—Limbach & Limbach

[57] ABSTRACT

The invention is a parts sorting tray in which small parts of any similar nature may be isolated and dumped into individual containers after they have been separated into four (or more) sorting chutes; the tray, to be known as "Quick Sort" uses only gravity to function, and can be easily cast from a flexible plastic material such as polyethylene.

2 Claims, 2 Drawing Sheets

SMALL PART SORTING TRAY

BACKGROUND

1. Field of Invention

This invention introduces a useful tool into the area of separation, for storage, of small mechanical, electrical, sewing or hobby parts. It will allow rapid manual selection and storing of said parts into desired separate containers.

2. Description of Prior Art

There is a current need for an easy to use compact sorting tray for small hardware items permitting rapid sorting by size, shape, color, purpose and for dissemination into containers.

There has been one design patented to fulfill this function, "Sorting Tray", Hoffman U.S. Pat. No. 4,643,316 (1984). It is two open trays joined together side by side, that is, having one common wall being moveable allowing parts to pass from one tray to the other, each tray having a separate funnel end. This double tray, however, appears clumsy to use and of limited sorting capacity, possessing but two (2) separate chambers for parts. In addition, this "Sorting Tray", U.S. Pat. No. 4,643,316 (1984) requires the operator to manually cover by hand or other means, one of the two funnel ends to prevent spilling, since it is not practical to dump into two separate containers at the same time.

FIGS. *2a* and *2b* are blown up details of the parts release door of an individual sorting chute, depicting the slots or grooves the chute doors slide in and nubs for holding the door in the closed position.

DETAILED DESCRIPTION OF THE INVENTION—FIGS. 1 TO 2

Figure 1:
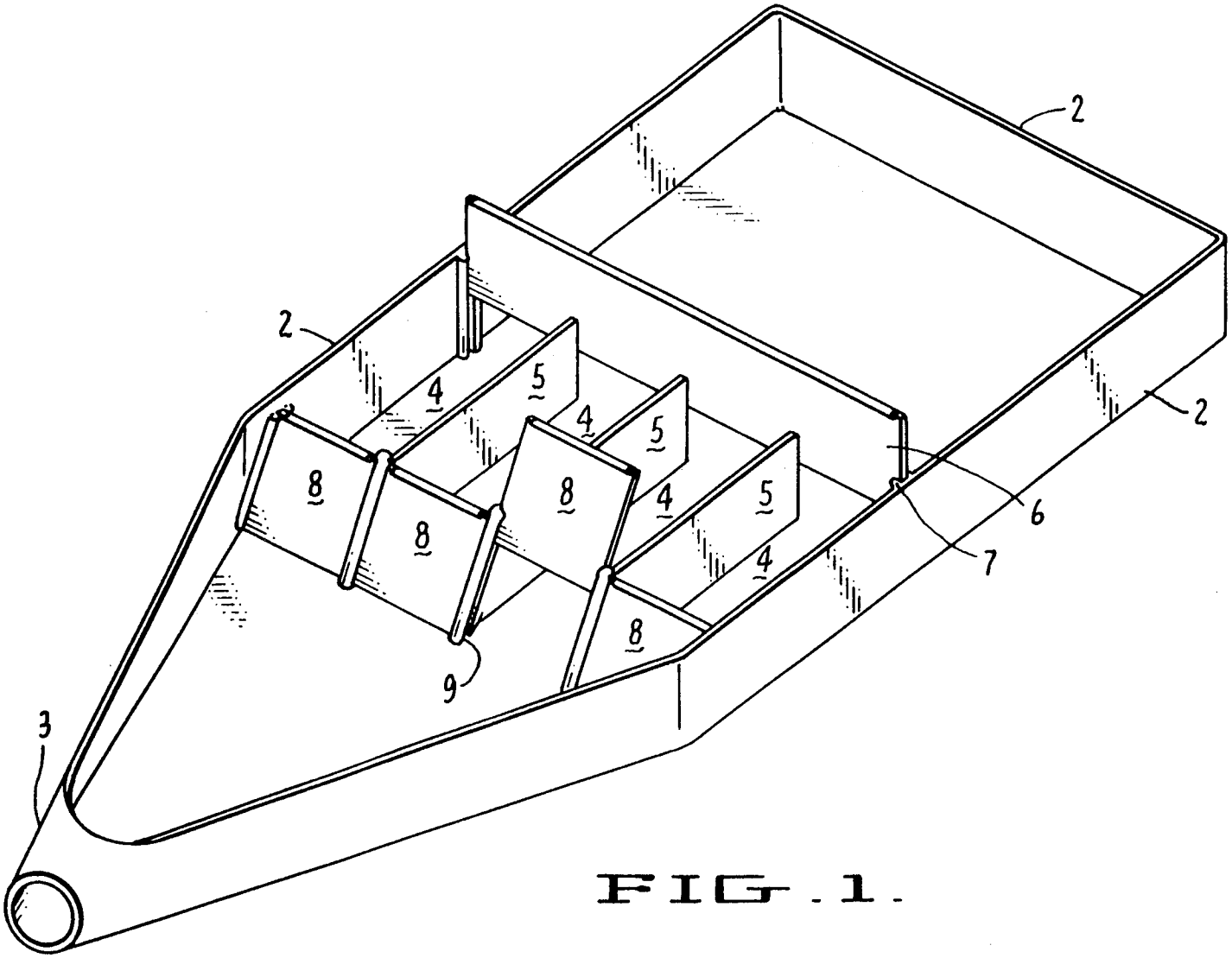
FIG. 1 is a perspective view of the sorting tray, illustrating a version of the tray having four (4) separate sorting chutes or chambers.
Figure 2B:
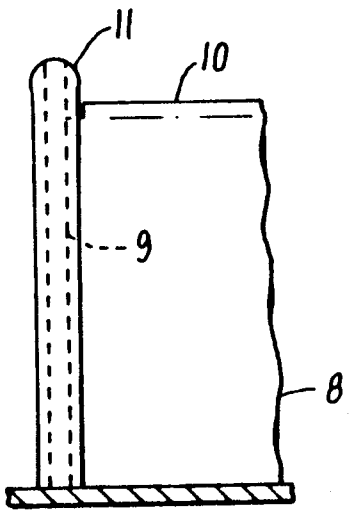
Figure 2A:
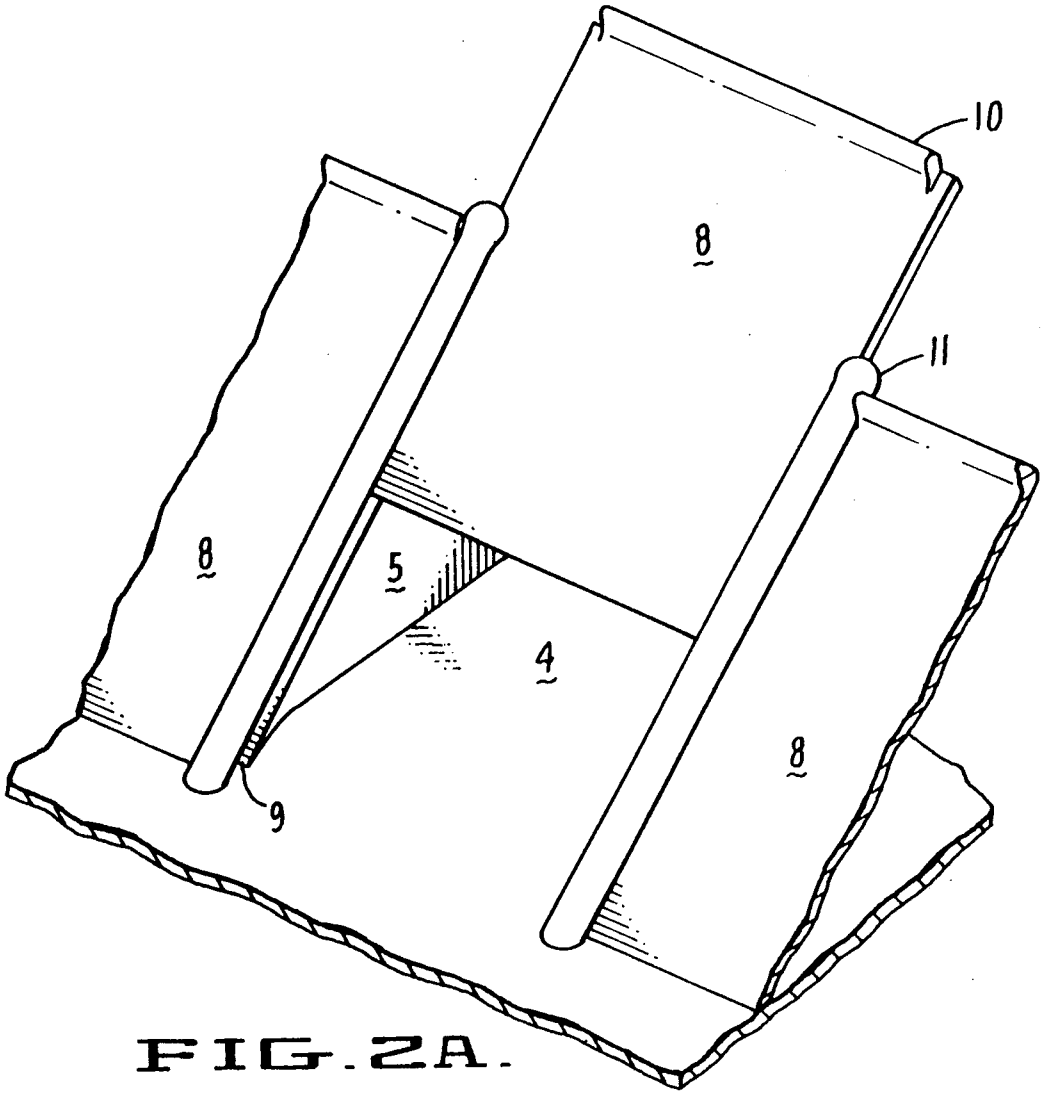

FIG. 1 is a drawing of the preferred embodiment of the invention. Refer to FIG. 1. The invention is comprised of a tray having a sorting floor or bottom, 1, bounded on three sides by the tray walls, 2, the two parallel walls converging at one end and forming a funnel end, 3, a means by which to deposit sorted items in containers. In the sorting floor, 1, and the funnel end, 3, are four sorting chutes, 4, separated by the chute walls, 5. The number of sorting chutes, 4, to be built into the tray is optional. The sorting chutes, 4, are separated from the sorting floor, 1, by a common entrance gate, 6, which is removable and is held in place between the tray walls, 2, by entrance gate slots 7. The other end of each sorting chute, 4, is closed by a chute door, 8, which slides open or closed in, but retained by chute grooves, 9; refer to FIG. 2 for a drawing of chute door installation. Again, referring to FIG. 2, each chute door, 8, slides in two chute grooves, 9, the chute grooves being cast into the exit end of the chute walls, 5; the chute doors, 8, and their retaining grooves are set at an angle (approximately 60 degrees in the preferred embodiment), to the tray floor. Each individual chute door, 8, has a grip rail, 10, so that it may be easily moved in the chute grooves, 9; the grip rail, 10, is cast in the door at a width slightly less that the width of the chute door, 8, so that the ends of grip rail, 10, can be forced past the retaining nubs, 11, thereby positively locking the chute door in the closed position. This invention is designed to be cast from a soft yet strong plastic such as polyethylene; this will impart the required resiliency to the retaining nubs, 11, and the ends of the grip rails, 10.

OPERATION—FIGS. 1 TO 2

A typical operation of the invention begins with the operator dumping, from his storage containers, a quantity of items to be separated by size, shape, onto the sorting floor, 1. At this time the entrance gate, 6, is removed from gate slots, 7, set in the tray walls, 2. The operator now manually selects four different size/shape items (machine screws for example) and directs them into individual sorting chutes, 4, first closing the chute doors, 8, and insuring that the ends of the grip rails, 10, are forced past the retaining nubs, 11, so that the chute doors, 8, cannot inadvertently loose the contents of the chute before the operator is ready.

After all the items of the four selected sizes have been put into respective sorting chutes, 4, the entrance gate, 6, is replaced in the closed position. At this time the operator can slant the tray with the funnel end, 3, placed over the desired container and open a chute door, 8, allowing the contents of that chute to slide, by gravity, through the funnel, 3, into the container. Each of the other sorting chutes, 4, is then emptied as desired and the chute doors, 8, returned to the closed position. The closed entrance gate, 6, has kept remaining items to be separated in the sorting area, 1. The operation is now repeated until all desired items have been separated. If there are unsorted items remaining in the tray, they may be dumped into the original container by opening the entrance gate, 6, and chute doors, 8, at the same time, thereby allowing all items to flow through funnel end, 3.

Other embodiments of the invention could vary the number of sorting chutes, have hinged chute doors instead of sliding doors, vary the angle of sliding doors and entrance gate to the floor of the tray, or use individual entrance gates for each sorting chute.

The sorting tray described in the application is easy to use, takes less space and has the capability of sorting a greater variety of parts, than Hoffman's U.S. Pat. No. 4,643,316, since it is in a single tray having multiple (four or more) separate sorting chambers or chutes which maybe used to segregate and hold parts of differing varieties and sizes before dumping them into desired storage containers. It is possible to separate and store many varieties of items with the invention described herein.

The forgoing description of the preferred embodiment of the invention has been presented for the purposes of illustration and description. It is not intended to be exhaustive or to limit the invention to the precise form disclosed. Many modifications and variations are possible in light of the above example. It is intended that the scope of the invention be limited not by the above detailed description, but rather by the claims appended hereto.

What is claimed is:

1. A compartmented tray for quickly sorting small parts of different size and variety comprising:

a tray having a sorting portion and a funnel portion;

a plurality of chutes, each chute providing accessibility from the sorting portion to the funnel portion of said tray;

an entrance gate separating the chutes from the sorting portion of the tray, said gate being openable while sorting parts and closable while removing sorted parts from one of the chutes via the funnel portion of said tray; and a plurality of chute doors, each chute door separating one of the chutes from the funnel portion of the tray and being openable for removing sorted parts from said chute.

2. The compartmented tray of claim 1 wherein the tray has a floor, each chute door forming an acute angle with the tray floor.

* * * * *